US006837298B2

(12) United States Patent
Rühle

(10) Patent No.: US 6,837,298 B2
(45) Date of Patent: Jan. 4, 2005

(54) METHOD OF PRODUCING BY CASTING A PISTON WITH A COOLED RING CARRIER

(75) Inventor: Martin Rühle, Stuttgart (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/416,999

(22) PCT Filed: Oct. 19, 2001

(86) PCT No.: PCT/DE01/04003

§ 371 (c)(1),
(2), (4) Date: Sep. 3, 2003

(87) PCT Pub. No.: WO02/40202

PCT Pub. Date: May 23, 2002

(65) Prior Publication Data

US 2004/0026062 A1 Feb. 12, 2004

(30) Foreign Application Priority Data

Nov. 18, 2000 (DE) ..... 100 57 366

(51) Int. Cl.[7] ..... B22D 19/00

(52) U.S. Cl. ..... 164/100; 164/48; 164/75; 164/61

(58) Field of Search ..... 164/100, 98, 75, 164/61

(56) References Cited

U.S. PATENT DOCUMENTS

| | | | | |
|---|---|---|---|---|
| 3,945,423 A | * | 3/1976 | Hannig | 164/75 |
| 4,120,081 A | * | 10/1978 | Rosch et al. | 29/888.045 |
| 5,322,109 A | * | 6/1994 | Cornie | 164/97 |

FOREIGN PATENT DOCUMENTS

| | | |
|---|---|---|
| DE | 374591 | 4/1923 |
| DE | 2000249 | 9/1971 |
| DE | 2410140 | 9/1975 |
| DE | 7617370 | 7/1976 |
| DE | 3504376 | 11/1986 |
| DE | 895726 | 7/1990 |
| DE | 19750021 | 5/1999 |
| DE | 19825848 | 12/1999 |
| EP | 0957256 | 11/1999 |
| GB | 2125517 | 3/1984 |
| GB | 2129523 | 5/1984 |
| JP | 59110848 | 6/1984 |

* cited by examiner

*Primary Examiner*—Tom Dunn
*Assistant Examiner*—Ing-Hour Lin
(74) *Attorney, Agent, or Firm*—Collard & Roe, P.C.

(57) ABSTRACT

To prevent, in a cooled ring carrier (1) for pistons, durinh Alfin bonding, the formation of oxides induced by air that escapes due to porous ring carrier material and, as a consequence, an impairment of the ring carrier bond. To this end, the cooled ring carrier, once the ring carrier part and the sheet metal part (3) have been linked, is subjected to negative pressure in a vacuum tank.

2 Claims, 1 Drawing Sheet

METHOD OF PRODUCING BY CASTING A PISTON WITH A COOLED RING CARRIER

CROSS REFERENCE TO RELATED APPLICATIONS

Applicants claim priority under 35 U.S.C. §119 of GERMANY Application No. 100 57 366.5 filed on 18 Nov. 2000. Applicants also claim priority under 35 U.S.C. §365 of PCT/DE01/04003 filed on 19 Oct. 2001. The international application under PCT article 21(2) was not published in English.

BACKGROUND OF THE INVENTION

The invention relates to a method for producing a piston with a cooled ring carrier, consisting of a ring carrier part and a sheet-metal part linked with it.

Such a ring carrier and a corresponding production method are known from DE 19750021. The cooled ring carrier is Alfin-bonded in an aluminum-base melt before having the piston material cast around it. During Alfin bonding, a layer of iron aluminides forms on the iron base material, which layer serves as a bonding layer between the aluminum material and the iron material of the ring carrier in the piston. The ring carrier part normally consists of a Niresist material with a lamellar graphite structure.

It has now been shown that during Alfin bonding of the cooled ring carrier, the gas pressure in the cooling channel increases and, since the ring carrier material is not always present in pore-free form, that in an individual case, surprisingly, entrapped air can actually escape from the cooling channel. This results in the formation of oxide skins in the Alfin bath, which skins adhere to the cooled ring carrier and represent defects in the ring carrier bond on the finished piston.

SUMMARY OF THE INVENTION

The invention therefore deals with the problem of preventing defects in the ring carrier bond of cooled ring carriers. This problem is achieved, by a method for producing a piston with a cooled ring carrier, consisting of a ring carrier part and a sheet-metal part linked with it, which forms a cooling channel in connection with the ring carrier part whereby the cooled ring carrier is Alfin-bonded in an aluminum-base melt before having the piston material cast around it. Once the ring carrier part and the sheet-metal part have been linked, the cooled ring carrier is subjected to negative pressure in a vacuum tank.

Linking of the ring carrier part and the sheet-metal part is supposed to take place by means of a linking method that is normally gas-tight, for example by means of welding or soldering.

As a result of the application of negative pressure, air entrapped in the cooling channel can escape, if the material of the ring carrier is porous, and the formation of excess pressure during Alfin bonding is prevented.

BRIEF DESCRIPTION OF THE DRAWING

The invention will be explained in greater detail in the following. The drawing shows.

DETAILED DESCRIPTION OF THE PREFERRED EMBODIMENTS

Figure 1:
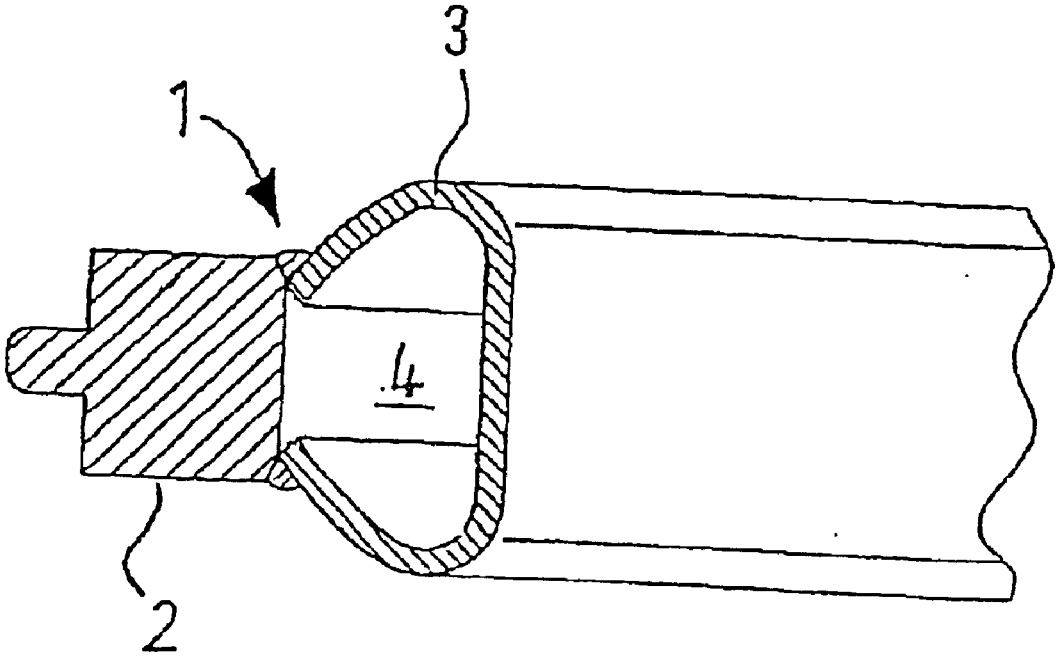
FIG. 1 a cooled ring carrier in the welded state.

The cooled ring carrier 1 consists of a ring carrier part 2 and a sheet-metal part 3 welded to the former, which jointly form a cooling channel 4 of a diesel piston.

Since the material of the ring carrier is not gas-tight in all cases, it can happen that during Alfin bonding of the cooled ring carrier, gas evolution and the formation of oxides and bubbles might take place, thereby damaging the ring carrier bond.

In order to avoid this, negative pressure is applied to the cooled ring carrier 1 or a plurality of ring carriers in a vacuum tank. The negative pressure can be 10 mbar, for example. Depending on the number of non-tight ring carriers, and as a function of the container volume, the negative pressure can increase to 20–50 mbar after some time.

In order to ensure pressure equalization in the case of the non-tight ring carriers, the ring carriers must remain in the evacuated vacuum tank for a minimum period of time, for example 24 hours.

A high level of productivity can furthermore be reached if a plurality of vacuum tanks filled with cooled ring carriers is evacuated at the same time, in a larger vat. This can be done in that the vacuum tanks have a lid that rests loosely against a rubber gasket.

During evacuation of the vat to a negative pressure of 10 mbar, for example, air can escape from the vacuum tanks because the lids rest loosely against the gaskets. As soon as the vat is vented, the lid forms a seal against the rubber gasket, so that the vacuum tank remains evacuated. The vacuum tank is not vented until just before removal of the cooled ring carriers, by way of a valve, and the ring carriers are dipped into the Alfin bath as soon as possible after being removed, in order to prevent air from flowing back into the non-tight ring carriers.

The vacuum tanks can be economically produced by using commercially available plastic tubes, cut to size, having a sufficient material thickness, and custom-lathed plastic lids that are provided with O-ring seals. The venting valve can be provided in the plastic lid.

What is claimed is:

1. A method of producing a piston with a cooled ring carrier, the ring carrier comprising a ring carrier part and a sheet-metal part, the method comprising linking the ring carrier part and the sheet metal part together to form a cooling channel in connection with the ring carrier part;

subjecting the cooled ring carrier to negative pressure in a vacuum tank after said step of linking to remove air entrapped in the cooling channel; and Alfin-bonding the cooled ring carrier in an aluminum-base melt before having piston material cast around the ring carrier.

2. Method according to claim 1, wherein the cooled ring carrier is removed from the vacuum-tank only shortly before being dipped into the Alfin bath.

* * * * *